US005667222A

United States Patent [19]

Bunyi

[11] Patent Number: 5,667,222

[45] Date of Patent: Sep. 16, 1997

[54] AUTOMATIC GOLF BALL TEE SETTER

[76] Inventor: Juan F. Bunyi, 2603 Kelliwod Lakes Dr., Katy, Tex. 77450

[21] Appl. No.: 318,283

[22] Filed: Oct. 5, 1994

[51] Int. Cl.[6] ..... A63B 57/00

[52] U.S. Cl. ..... 473/134; 473/417; 473/278

[58] Field of Search ..... 273/201, 179 B, 273/202, 33, 26 R, 187 R, 29 A

[56] References Cited

U.S. PATENT DOCUMENTS

| | | | |
|---|---|---|---|
| 2,127,282 | 8/1938 | Beckett . | |
| 2,711,321 | 6/1955 | McGraw, Sr. . | |
| 4,017,087 | 4/1977 | Bruno | 273/201 |
| 5,022,657 | 6/1991 | Bussiere et al. | 273/201 |
| 5,131,661 | 7/1992 | Jorgensen . | |
| 5,133,557 | 7/1992 | Sugimoto . | |
| 5,282,628 | 2/1994 | Komori et al. . | |
| 5,297,797 | 3/1994 | Lamontagne . | |
| 5,322,291 | 6/1994 | Smith et al. . | |
| 5,330,194 | 7/1994 | Copeland . | |

*Primary Examiner*—Vincent Millin
*Assistant Examiner*—Charles W. Anderson

[57] ABSTRACT

The present invention relates to a golf ball teeing apparatus. The apparatus is adapted to rotate about a frame and deliver golf balls to be automatically teed. The golf ball elevating apparatus is a levered system which positively loads and elevates golf balls above the platform. The golf ball delivery apparatus includes a golf ball magazine adapted to deliver golf balls to a delivery chute while preventing jamming of the golf balls.

12 Claims, 9 Drawing Sheets

AUTOMATIC GOLF BALL TEE SETTER

FIELD OF THE INVENTION

The present invention relates to a golf station for use as a practice station or as a teeing station on a golf hole. More particularly, the present invention relates to a portable golf station adaptable for commercial or home use capable of automatically teeing a golf ball and rotating through 360° for use by both right and left handed golfers.

BACKGROUND OF THE INVENTION

Various golf practicing and teeing devices have been designed in the past, some of which were actuated by human-power alone. However, these devices were generally complex, cumbersome designs, which employed a multitude of moving parts to perform the function of teeing a golf ball. These past designs were typically plagued by wear caused from friction among the multitude of moving parts and springs, which resulted in frequent breakdowns and an increased necessity for maintenance. Many of these machines load the golf balls by gravity. The machinery stops the fall of the balls into the golf machine. Therefore, these machines are hindered by jamming during use.

For example, U.S. Pat. No. 5,330,194 issued to on Jul. 19, 1994, discloses a golf ball delivery device having a housing, a ball feeder, a ball channel, a tee, a piston, a delivery device, and a pivot handle to actuate the delivery device. The pivot handle is connected to levers under spring tension. Activation of the pivot handle lowers the piston and upon release of the pivot handle, the piston returns to an elevated position.

U.S. Pat. No. 5,322,291 issued to on Jun. 21, 1994, discloses a golf practice apparatus having a foot pedal coupled to a main shaft which upon depression of the foot pedal actuates a reciprocating ball dispenser. The ball dispenser dispenses a ball to be teed on a support. Releasing the foot pedal causes an air cylinder to raise the ball support and teed golf ball into a driving position.

U.S. Pat. No. 5,297,797 issued to on Mar. 29, 1994, discloses a golf ball step-feeding, self-teeing device having a base frame, a push-pull, remote, reciprocal, mechanical coupling with transmitter and receiver ends, drive powered transmitter end, a control to impart vertical, reciprocating movement to receiver end, a ball conveyor for transporting balls to receiver end, ball step feeder, and dampener to protect tee member of receiver end.

U.S. Pat. No. 5,282,628 issued to on Feb. 1, 1994, discloses an automatic golf ball dispenser and teeing apparatus having a breakaway captive setting arm, and a series of baffles.

U.S. Pat. No. 5,133,557 issued to Jul. 28, 1992, discloses a golf practicing apparatus having a vertical slider unit, means for driving the slider unit up and down, and an automatic control unit that performs sequence control on the vertical movement of the slider unit.

U.S. Pat. No. 5,131,661 Jul. 21, 1992, discloses a golf swing practice apparatus with automatic teeing device having a platform, a frame for supporting the platform, a tee supporting arm, a golf ball feed chute, drive means for pivoting the arm and the chute, and a tee mounted on the arm.

While all of the above listed inventions have worked for their intended purpose, there are several limitations which have not been solved by the prior art designs. One limitation is the inability of the platform to rotate thereby accommodating right and left handed golfers.

Another limitation is the absence of a positive ball loading device which prevents jamming of golf balls on delivery. Gravity feed type loading invites jamming when the actuator is depressed more than once.

Another limitation is the use of multiple moving parts which invites increased maintenance. Multiple arms or levers which must remain movably connected by springs or other means are subject to physical damage and operational jamming. Also, the use of air pistons to regulate the upward movement of a golf ball after delivery invites increased maintenance.

Another limitation is the use of complicated devices to accomplish adjustment of tee height.

Another limitation is the lack of a ball magazine which can be provided to a golfer for easy mounting and dismounting during use.

Another limitation is the inability of prior designs to be adapted for use on a golf course as the tee box on the individual golf holes or for home use. The prior designs do not possess portable characteristics.

SUMMARY OF THE INVENTION

The present invention relates to a rotatable golf station suitable for both right and left handed golfers and an apparatus for automatically delivering and teeing golf balls at the proper position within the golf station. The teeing mechanism is controlled by two levers operating about two fulcra. A first lever is operated via a pedal or ball actuator positioned on the platform. A second lever operates under force of the first lever to load the chamber and elevate a ball into the chamber. The second lever is counter balanced with an adjustable counter weight. The counter weight controls ball elevation. A ball magazine is removably attached to a delivery chute to deliver balls to the teeing apparatus. The ball magazine is constructed with internal tracks which deliver balls to the delivery chute while preventing jamming during the delivery of golf balls. The two exits merge in a Y configuration to enter the delivery chute. A pin valve operates as a gate allowing delivery from each exit in an alternating fashion. The golf balls are loaded into the chamber through positive action, not under gravity feed. Alternatively, the ball magazine can be a circular magazine with spiral tracks to sequentially load balls into the delivery chute.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

The above drawings illustrate different preferred embodiments, wherein like members bear like referenced numerals in the several figures.

DETAILED DESCRIPTION OF THE PREFERRED EMBODIMENT

Golf practice station

Figure 5:
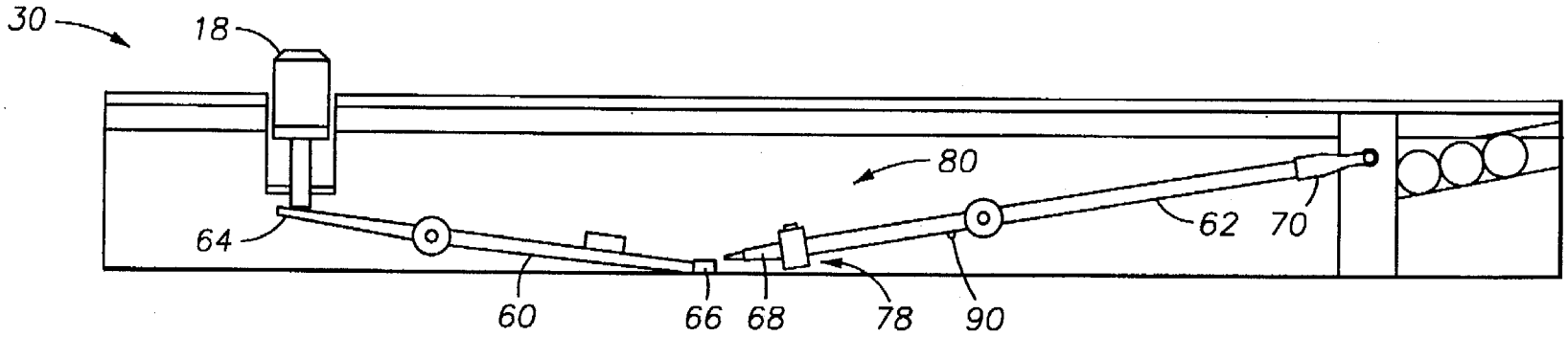
FIG. 5 is a side view of the golf station detailing the golf ball teeing apparatus.

The present invention can be better appreciated with a detailed description of the preferred embodiment. With reference to the accompanying drawings, a portable, stand alone golf station 2 is mounted on rotatable platform 4 which is recessed in a circular bottom L ring 6 and supported on casters 22. Bottom L ring 6 is made of aluminum angle configured in a circle. The station 2 includes an apparatus for delivering and teeing golf balls. A ball teeing apparatus 30 includes a dual levered mechanism (as seen in FIG. 5) which positively loads a golf ball and elevates the golf ball above the turf covered platform 4. Golf balls are delivered from a detachable golf ball magazine 16 which communicates with the ball teeing apparatus via delivery chute 14. Delivery chute 14 delivers golf balls to the teeing apparatus. The delivery chute 14 extends from ball magazine adapter to the teeing apparatus 30. Delivery chute 14 supports a tray for storing personal items. Further, delivery chute 14 supports release handles for dual braking systems and a choke type lever for adjusting tee height. Dual braking systems stabilize the platform in both lateral and rotational dimensions during performance of the golf swing.

Figure 1:
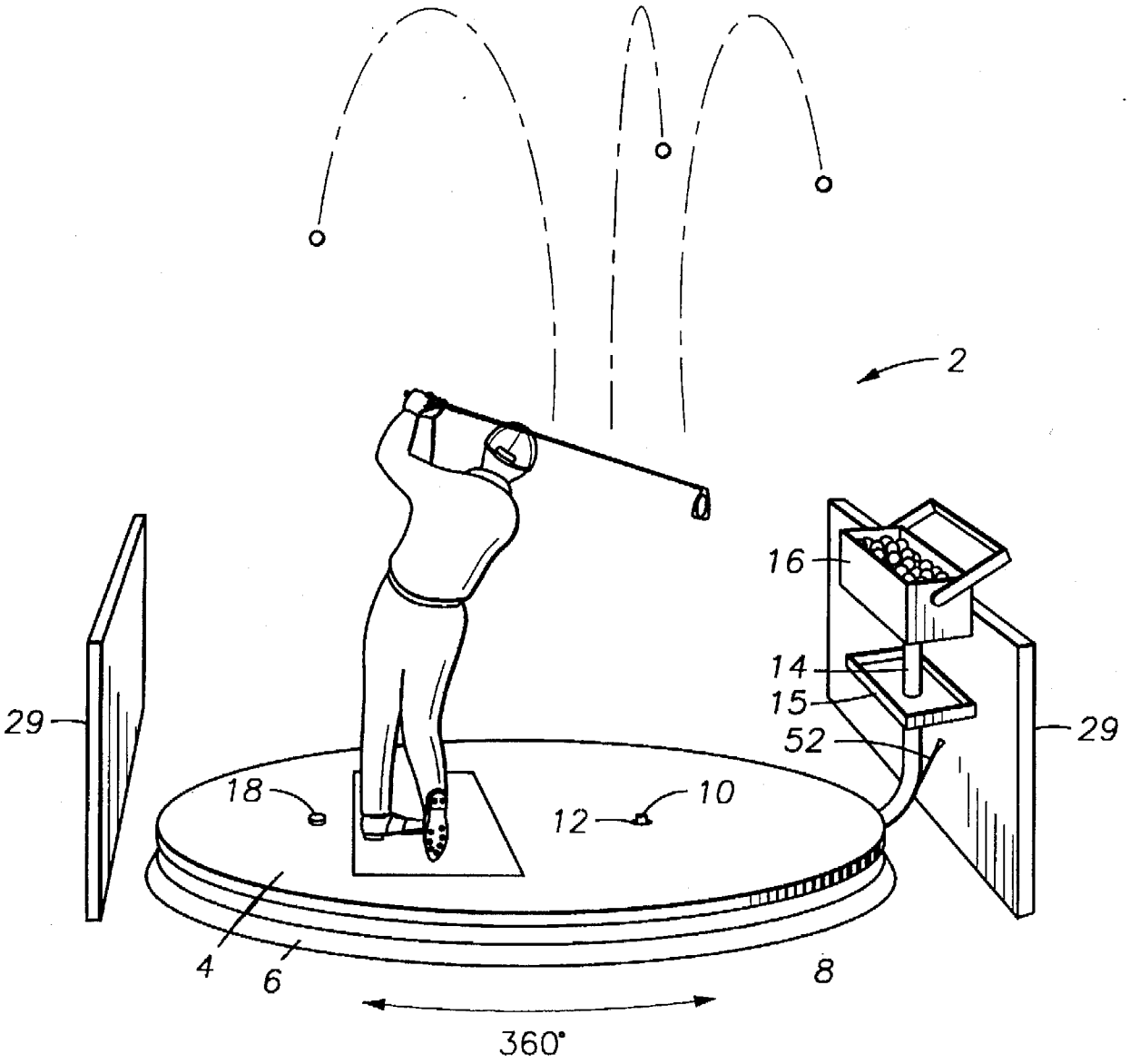
FIG. 1 is a perspective view of a golf station of the present invention.

FIG. 1 shows a perspective view of golf station 2. Platform 4 is mounted on casters 22 (shown in FIG. 4) and recessed in a frame member made of a circular L ring 6. Platform 4 is generally horizontal. A cross section of the circular ring 6 appears as an "L" with a side and bottom supporting rollers to be described below. Platform 4 is covered by rubber mat 8. Golf tee 10 comprised of a durable rubber or other suitable material movably extends through aperture 12 in platform 4 and rubber mat 8. Delivery chute 14 delivers golf balls from ball magazine 16 to a ball teeing apparatus 30 positioned below platform 4. Delivery chute 14 is rigidly attached to platform 4. The ball teeing apparatus 30 is actuated by a pedal 18 extending through platform 4. Delivery chute 14 supports two braking systems for the platform 4 and a cable mechanism which controls tee height. In addition, a miscellaneous tray 15 for personal items is supported on the ball delivery chute 14. Station dividers 20 may be positioned between stations for isolation and safety. In a portable version, light, durable plastics are employed to form the platform 4. A commercial version is employs an aluminum apparatus.

Figure 3:
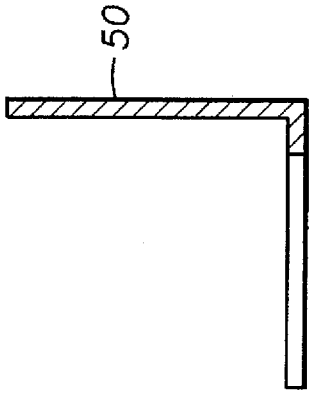
FIG. 3 is a side view of the "L" ring foundation.
Figure 2:
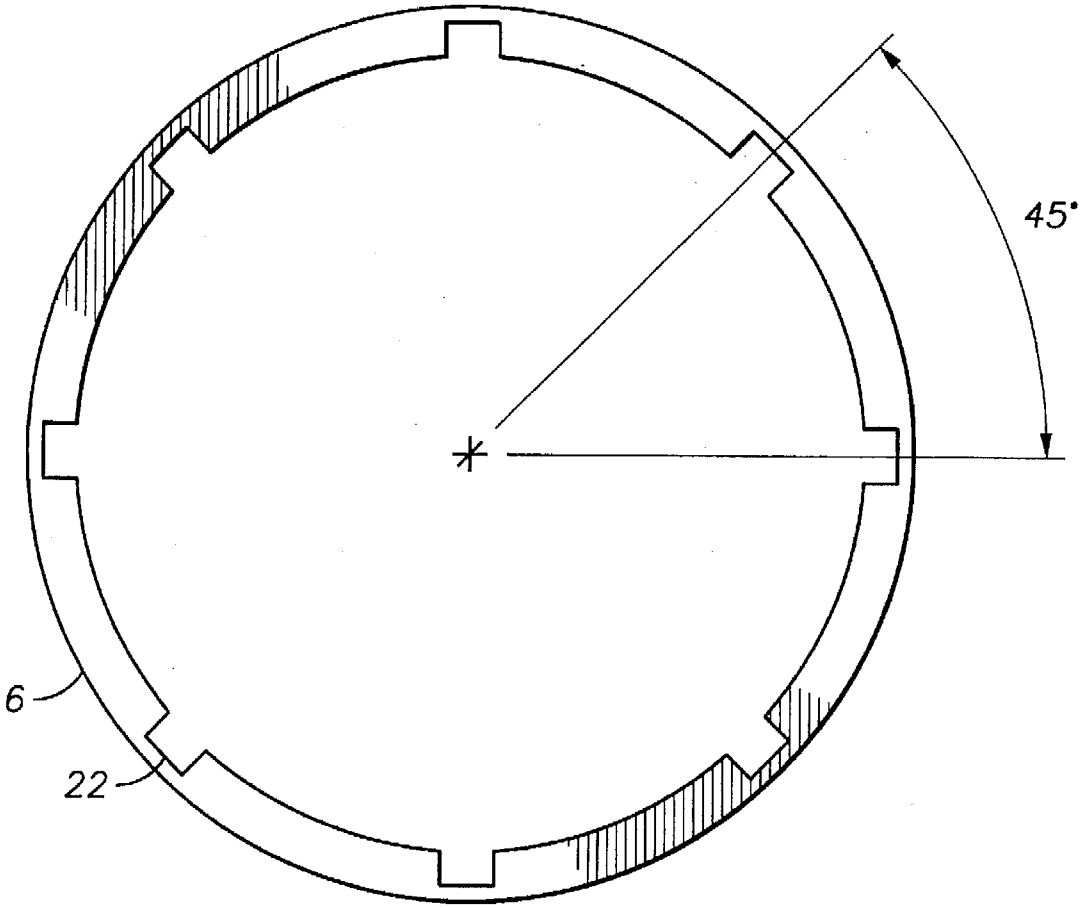
FIG. 2 is a top view of the rotation assembly of the golf station.

FIGS. 2 and 3 show the details of the bottom L ring 6 which supports golf station 2. Platform 4 is recessed within the bottom L ring 6 as shown in FIG. 2. Platform 4 is mounted on casters 22 which cooperate with bottom L ring 6. The bottom L ring 6 functions as a track or guide plate to guide the casters 22 through circular rotation within the bounds of L ring 6. While casters 22 are preferred, the platform may be mounted on other rotational means such as ball bearings.

Figure 4:
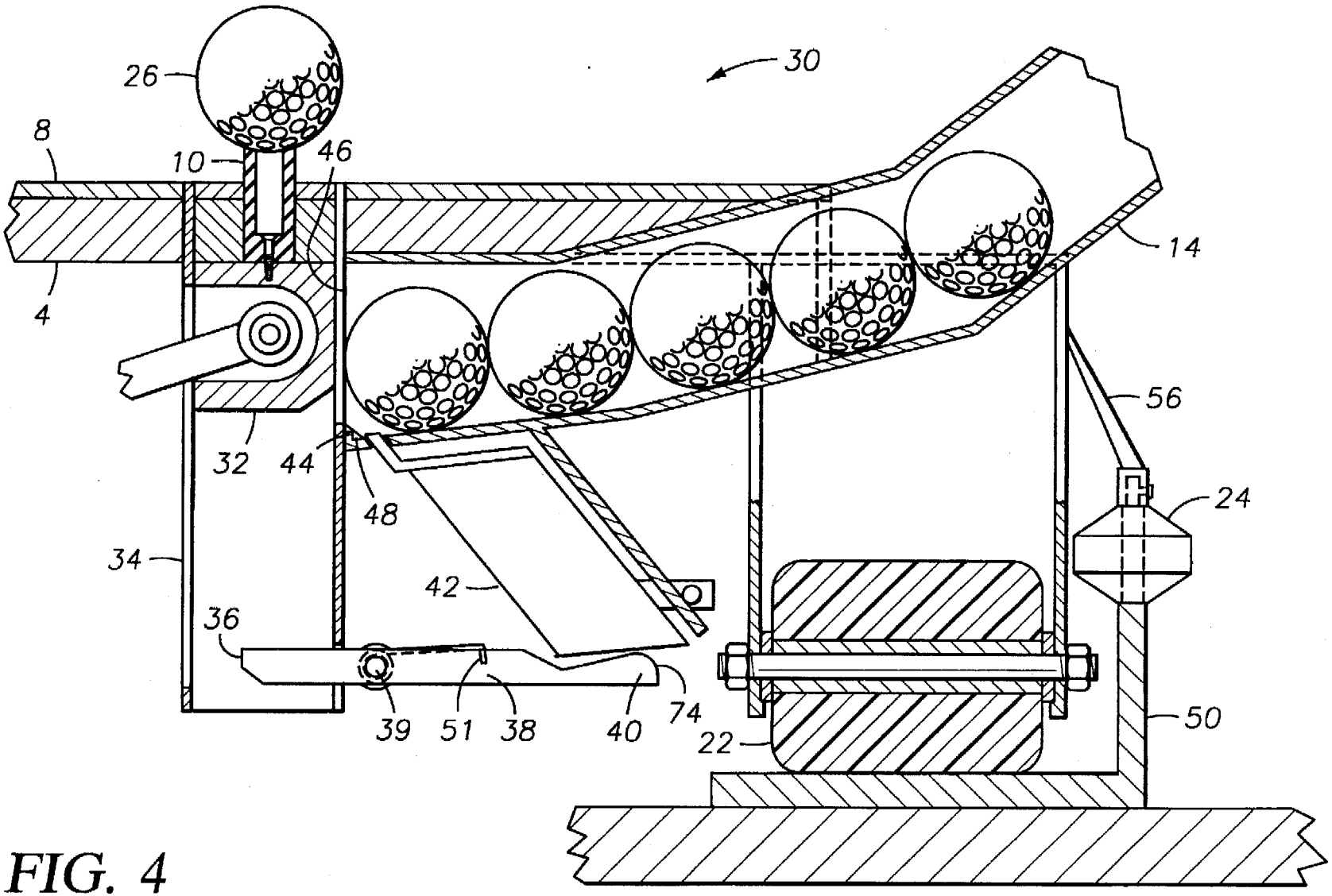
FIG. 4 is a side view of the golf ball teeing apparatus.

FIG. 4 shows a side view of ball teeing apparatus 30 and the rotational system of golf station 2. Horizontal caster 22 and vertical casters 24 positioned in the L ring 6 enable rotational movement of platform 4 of golf station 2. Deliver chute 14 serves as an arm which the golfer firmly grasps to rotate platform 4. Golf ball 26 is shown elevated on golf tee 10. Golf tee 10 is threadedly attached to piston member 32. The piston member 32 is housed within a loading chamber 34. Piston member 32 in descent contacts force end 36 of a loading lever 38. Depression of the force end 36 of loading lever 38 results in elevation of loading end 40 of loading lever 38. Elevation of loading end 40 results in elevation of loading pin 42. As loading pin 42 is actuated upward, it pushes the golf ball over ledge 44 through window 46 and onto the golf tee 10 when the piston member 32 is depressed. A safety mechanism is employed to prevent jamming or destruction of components when a ball has previously been loaded and pedal is depressed. A spring 51 serves as the safety mechanism. Spring 51 connects loading lever 38 to enable loading lever 38 to slip past loading pin 42 to prevent jamming of components when the pedal is depressed a second time with ejection of a golf ball from the tee.

Delivery chute 14 descends from above platform 4. At its upper most end, delivery chute 14 is adapted to cooperate with golf ball magazine 16. At its lower end, delivery chute 14 enters ball teeing apparatus 30. Delivery chute 14 can be made of a polymer material or a suitable metal such as aluminum. Delivery chute 14 terminates at its lower end at the loading chamber 34. Ledge 44 is formed by the wall of loading chamber 34. Loading chamber 34 has a window 46 formed above ledge 44. Filler 48, made of a molded plastic, is fitted in the corner formed by the ledge 44 and delivery chute 14. Filler 48 is contoured to approximate the curvature of a golf ball. Golf balls abut the filler 48 and the ledge 46 until a ball is positively elevated up over ledge 44 into loading chamber 34 on a piston member 32.

Horizontal casters 22 and vertical casters 24 are preferably made of a durable plastic material or nylon. Horizontal casters 22 support platform 4 in the vertical dimension. Horizontal casters 22 serve as legs which support platform 4. Horizontal casters 22 enable platform rotation.

Vertical casters 24 are positioned in vertical wall 50 of L ring 6. Vertical casters 24 restrict lateral movement of platform 4, when platform 4 contacts vertical casters 24.

Horizontal casters 22 and vertical casters 24 have braking assemblies very similar to hand brakes employed in automobiles. Brake pads releasably communicate with both sets of casters to disable rotation. A brake cable extends from the brake assemblies to a brake handle 52 positioned on delivery chute 14. On release of the braking system, platform 4 rotates freely on horizontal casters 22. Platform 4 may be rotated through any angle. In normal use, platform 4 is rotated through 180° to accommodate right handed and left handed golfers.

The first braking system acts on horizontal casters 22. This first braking system stabilizes the platform in the rotational dimension. On activation of the braking system, platform 4 is prevented from rotating on horizontal casters 22 along bottom L ring 6.

The second braking system operates to prevent lateral movement of platform 4. This second braking system acts on the vertical casters 24. Horizontal casters 22 are positioned under the platform 4 in a relationship which forms a gap between the outer edge of horizontal casters 22 and bottom L ring 6. This space allows free rotation of platform 4 and horizontal casters 22 without interference from the walls of L ring 6.

A golfer manually rotates platform 4 once he releases brake handle 52 of the braking systems. The golfer steps down to the floor, releases the braking system and rotates platform 4. After rotation is complete, brake handle 52 is returned to a normal state so that the brakes exert a force on the horizontal casters 22 and 24 and vertical casters 24. Platform 4 cannot rotate unless brake handle 52 is manipulated to release the braking systems.

The golf station is constructed of an aluminum platform 4 of circular dimension. The circular platform 4 preferably has a radius of 5 feet. The surface area of the platform must be sufficient to support a golfer positioned the requisite distance from a golf ball at the address position using the various golf clubs employed by golfers. The surface of platform 4 is covered with rubber mat 8. Artificial turf grass 54 is secured on top of rubber mat 8. Bottom L ring 6 is preferably made of aluminum angle having dimensions of 2½×2½ inches. The dimensions of the L ring and diameter of the L ring 6 may vary. The platform 4 having a diameter of five feet is sufficiently supported by the aluminum L ring members.

A rubber seal 56 extends about the perimeter of platform 4 to prevent pollution and moisture from entering the mechanical chamber housed beneath platform 4. Rubber seal 56 extends between vertical wall of platform 4 and the vertical wall 50 of the L ring 6. While not completely air tight, rubber seal 56 minimizes entry of pollution under the platform where the working parts are housed. This addition minimizes corrosion and resulting harm to the working parts of the golf station.

Bottom L ring 6 is preferably set on a concrete foundation. The foundation is contoured in a conical or funnel shape to assist in drainage. While concrete foundations are preferable, bottom L ring 6 assembly, can equally be established on a dirt floor. Even with a dirt floor, contour is necessary to facilitate drainage and prevent retention of any water which may seep under the rubber seal.

Tee-setting mechanism

FIG. 5 shows the detailed construction of the ball teeing apparatus 30. The ball teeing apparatus 30 is comprised of first and second levers 60, 62. The two levers 60, 62 cooperate to translate the depression of foot pedal 18 into descent of piston member 32 to achieve positive ball loading.

Foot pedal 18 under spring tension cooperates with force end 64 of first lever 60. As foot pedal 18 is depressed, force end 64 of first lever 60 is depressed. Load end 66 of first lever 60 cooperates with force end 68 of second lever 62.

Load end 70 of second lever 62 communicates with piston member 32 of loading chamber 34. Piston member 32 on depression of load end 70 of second lever 62 activates loading lever 38 which communicates with loading pin 42. Loading lever 38 is practically disposed in the lower portion of loading chamber 34. Force end 36 of loading lever 38 extends into loading chamber 34 at the lower portion of loading chamber 34. Loading lever 38 extends through a slot 72 (shown in FIG. 11) defined by the lower portion of loading chamber 34. Load end 40 of loading lever 38 communicates with the force end 74 of loading pin 42. Load end 76 of loading pin 42 is constructed to elevate and horizontally displace a golf ball into loading chamber 34 through window 46. The upper end of loading pin 42 is slightly angled to displace ball through window 46 formed at upper end of loading chamber 34.

Force end 68 of second lever 62 has counterweight 78 positioned thereon. Counterweight 78 causes elevation of piston member 32 into ready position. As the first and second levers 60,62 reach slipping point 80 following depression of foot pedal 18, counterweight 78 acts to force second lever 62 past first lever 60 and elevate piston member 32. Counterweight 78 must be positioned appropriately (adjustment may be necessary) to enable smooth elevation of piston member 32 and golf ball without ejecting golf ball off golf tee and through the air. Counterweight 78 is moved to an appropriate position and secured by turning a screw to snugly abut second lever 62.

A come and pulley may be employed with foot pedal 18 and first lever 60 to further decrease the resistance of the foot pedal 18 upon depression. Such a mechanical advantage cable may extend from foot pedal 18 to first lever 60. This assistance by the common pulley decreases force necessary to depress the foot pedal 18 and elevate piston member 32.

First lever 60 contains a door latch type mechanism at force end 66 (shown in FIGS. *7a* and *7b*). Upon depression of foot pedal 18, first lever 60 elevates second lever 62. As second lever 62 slips past first lever 60, counter weight 78 causes force end 68 of second lever 62 to descend to a resting position. As first lever 60 is lowered, first lever's door latch mechanism contacts force end 68 of second lever 62 allowing the first lever 60 to pass over second lever 62 in the resting position. The door latch member 82 retracts against spring 84 on contact with force end 68 of second lever 62 and extends on clearance of second lever 62.

At the load end 66 of first lever 60 a bore 86 houses spring 84. Spring 84 forces door latch member 82 into an extended position. Door latch member 82 is angled at its disposed end 88 which communicates with second lever 62 as first lever 60 falls after slipping point 80 is reached. Angled portion 88 of the door latch member 82 contacts the second lever 62. Door latch member 82 is depressed under this force. First lever 60 then slips past the second lever 62 and door latch member 88 is extended under second lever 62. After door latch member 82 is extended under second lever 62, the apparatus is reset and ready for operation.

First lever 60 may be angled slightly so that it slips past the second lever 62 without necessity of door latch type mechanism 81.

Cam and shaft 90 enable a golfer to adjust golf tee 8 height. Cam and shaft 90 are connected to a cable with a casing extending up delivery chute 14 to a knob positioned on delivery chute 14. Cam and shaft 90 operate like a choke or accelerator in automobiles. A cable enables the operator to pull and push a throttle-type knob so that cam is twisted and makes the golf tee 8 lower or higher. The adjustment makes foot pedal 18 extend higher or lower above platform 4. Cam 90 serves as a stop to keep force end 68 of second lever 62 elevated so that door latch mechanism 81 of load end 66 of first lever 60 is able to slip past second lever 62.

Counterweight 78 forces loaded piston member 32 to the top of loading chamber 34.

Figure 6:
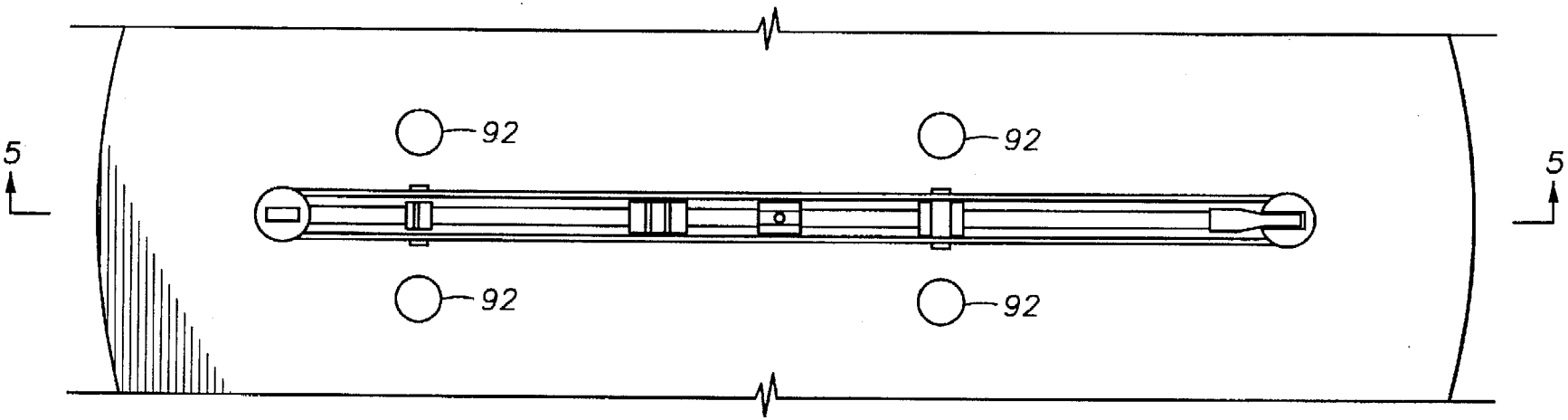
FIG. 6 is a top view of the golf station and golf ball teeing apparatus.

FIG. 6 is a top view of golf station 2. Teeing apparatus 30 removably inserts into platform 4. Delivery chute 14 includes a coupling which connects two pieces of the delivery chute. A first portion is fixedly attached to teeing apparatus 30. Teeing apparatus 30 may be completely removed from the platform 4. A second delivery chute member extends the chute 14 to an appropriate height for positioning golf ball magazine 16. Four hand holes 92 are positioned on either side of the teeing apparatus 30. These hand holes 92 are positioned on either side of fulcra of first and second levers 60,62. As is shown, teeing apparatus 30 is disposed within an elongate ditch under platform 4. To facilitate maintenance, hand holes 92 are positioned so that an operator can reach through hand holes 92 and manipulate the working members of teeing apparatus. In addition, rubber mat 8 and artificial turf grass 54 can be removed and the elongate section of teeing apparatus can be removed. In normal operation, this is not necessary but it is a feature of the present invention. Preferably, all maintenance can be done through hand holes 92 positioned on either side of the elongate ditch.

FIG. 6 shows an opening which serves as a manhole for repair purposes. Platform 4 can be retracted by hand simply by grabbing and lifting hand holes 92. First and second levers 60, 62 can then be reached for repair. This access eliminates the need to lift platform 4 to repair unforeseen problems. The artificial grass turf 54 can be removed from over slot housing teeing apparatus so that the hand holes are exposed.

Figure 7A:
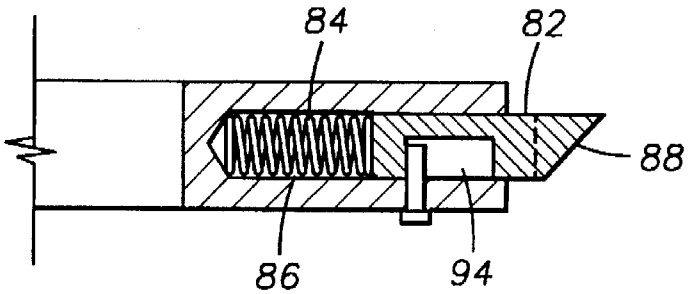
FIG. 7*a* is a side view of the door latch type mechanism of the first lever.
Figure 7B:
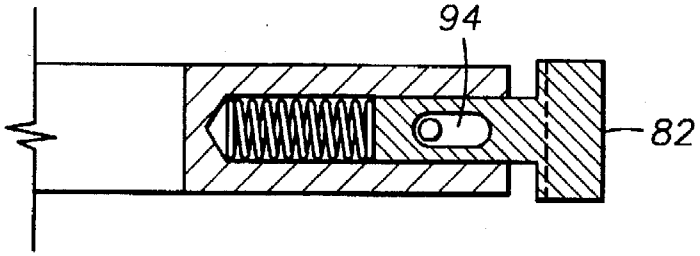
FIG. 7*b* is a top view of the door latch type mechanism of the first lever.

FIG. 7 illustrates door latch type mechanism 81 which is housed within load end 66 of first lever 60. Door latch-type mechanism 81 operates very similar to a door latch. Bore 86 is drilled in force end 66 of first lever 60. Door latch member 82 is disposed within bore 86 and load end 66 of first lever 60. Door latch member 82 is a T-shaped member. Spring 84 forces door latch member 82 to an outer most position. Slot 94 is positioned within door latch member 82 so that door latch member 82 can be secured by pin 96. Pin 96 serves as a retainer preventing over extension of the door latch member 82 or increased retraction of the door latch member 82.

Figure 8A:
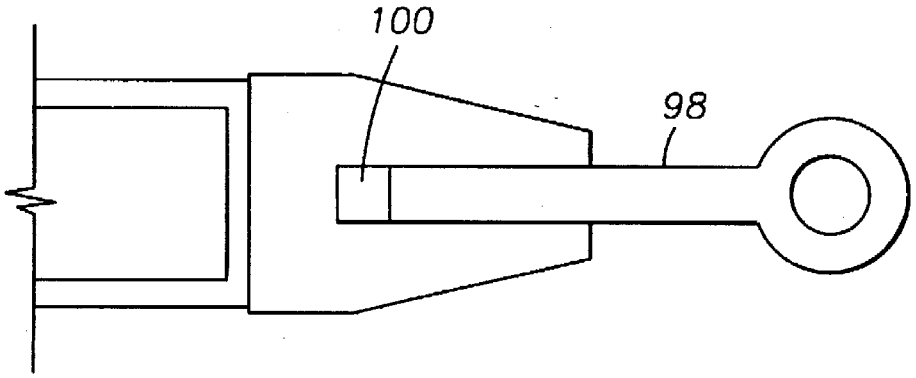
FIG. 8*a* is a side view of the sliding arm connection of the second lever.
Figure 8B:
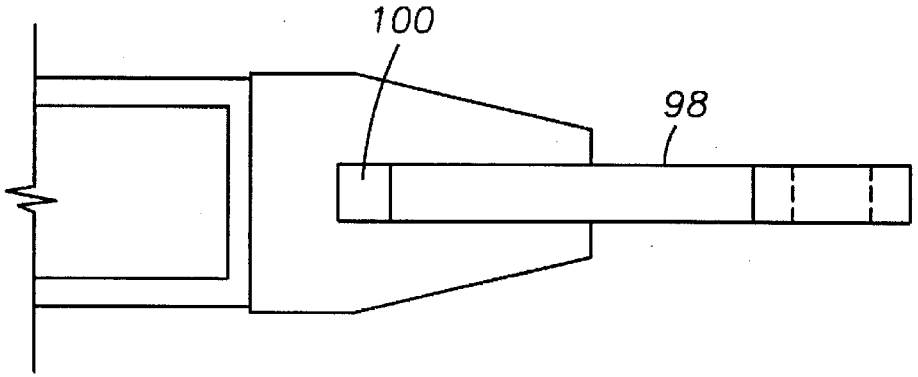
FIG. 8*b* is a top view of the sliding arm connection of the second lever.

FIG. 8 shows the reciprocating end of the load end 70 of second lever 62. Rod 98 extends to connect with piston member 32 housed loading chamber 34. As load end 70 of second lever 62 is moved up and down, the relationship of second lever 62 and loading chamber 34 differs. Therefore, it is necessary for load end 70 of second lever 62 to extend and contract to accommodate descent of piston member 32. This reciprocating member 98 is disposed within a bore 100 which is positioned in load end 70 of second lever 62. A nylon bushing is disposed in bore 100 to facilitate sliding action of reciprocating member 98. Reciprocating member 98 is slidably housed within bore 100 of second lever 62. Upon descent of load end 70 of second lever 62, reciprocating arm 98 retracts into second lever 62. As counterweight 78 elevates load end 70 of second lever 62, the reciprocating arm 98 extends to an extended position. This movement accommodates piston action piston member 32 housed in loading chamber 34.

Delivery chute 14 descends below platform 4. The lower portion of delivery chute 14 elbows to descend under platform 4. Golf balls are fed from golf ball magazine 16 down towards the distal most portion of delivery chute 14.

If a heavier positive force elevating the ball is desired, counterweight 78 can be positioned at the end of the second lever until the distance between the mass and the fulcrum is at a maximum. The tee 8 is made of neoprene rubber to withstand displacement at impact with a golf club.

Loading chamber

Figure 9:
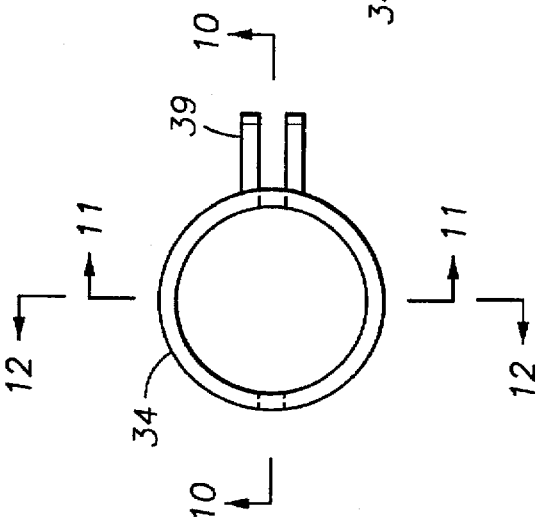
FIG. 9 is a top view of the elevating chamber.

FIGS. 9, 10, 11, and 12 detail loading chamber 34. FIG. 9 is a top view of loading chamber 34 showing the circular dimension of loading chamber 34. Inside diameter 35 of loading chamber 34 is slightly larger than the diameter of a golf ball. The golf ball on entry into loading chamber 34 is positioned approximately in the center of chamber 34. This enables successful loading of the golf ball onto golf tee 10 which is centered in loading chamber 34.

Figure 10:
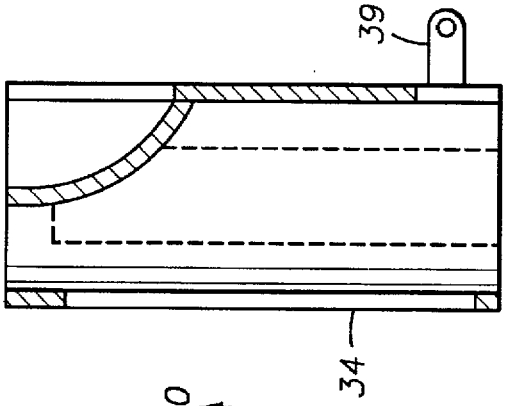
FIG. 10 is a side view along the line A—A in FIG. 9.

FIG. 10 is a side view of loading chamber 34 along line A—A in FIG. 9. Loading lever 38 is mounted on fulcrum assembly 39.

Figure 11:
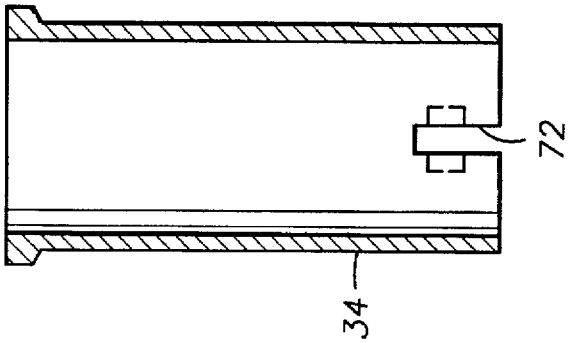
FIG. 11 is a side view along the line B—B in FIG. 9.

FIG. 11 is a side view of loading chamber 34 along line C—C in FIG. 9. Slot 72 is shown through which loading lever 38 extends.

Figure 12:
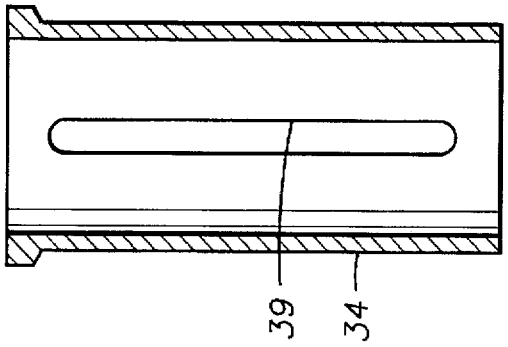
FIG. 12 is a side view along the line C—C in FIG. 9.

FIG. 12 is a side view of loading chamber 34 along line B—B in FIG. 9. Slot 39 is shown through which rod 98 of second lever 62 extends. Rod 98 slidably moves along walls defining slot 98 on elevation and decent of second lever 62.

Golf ball magazine

Figure 13:
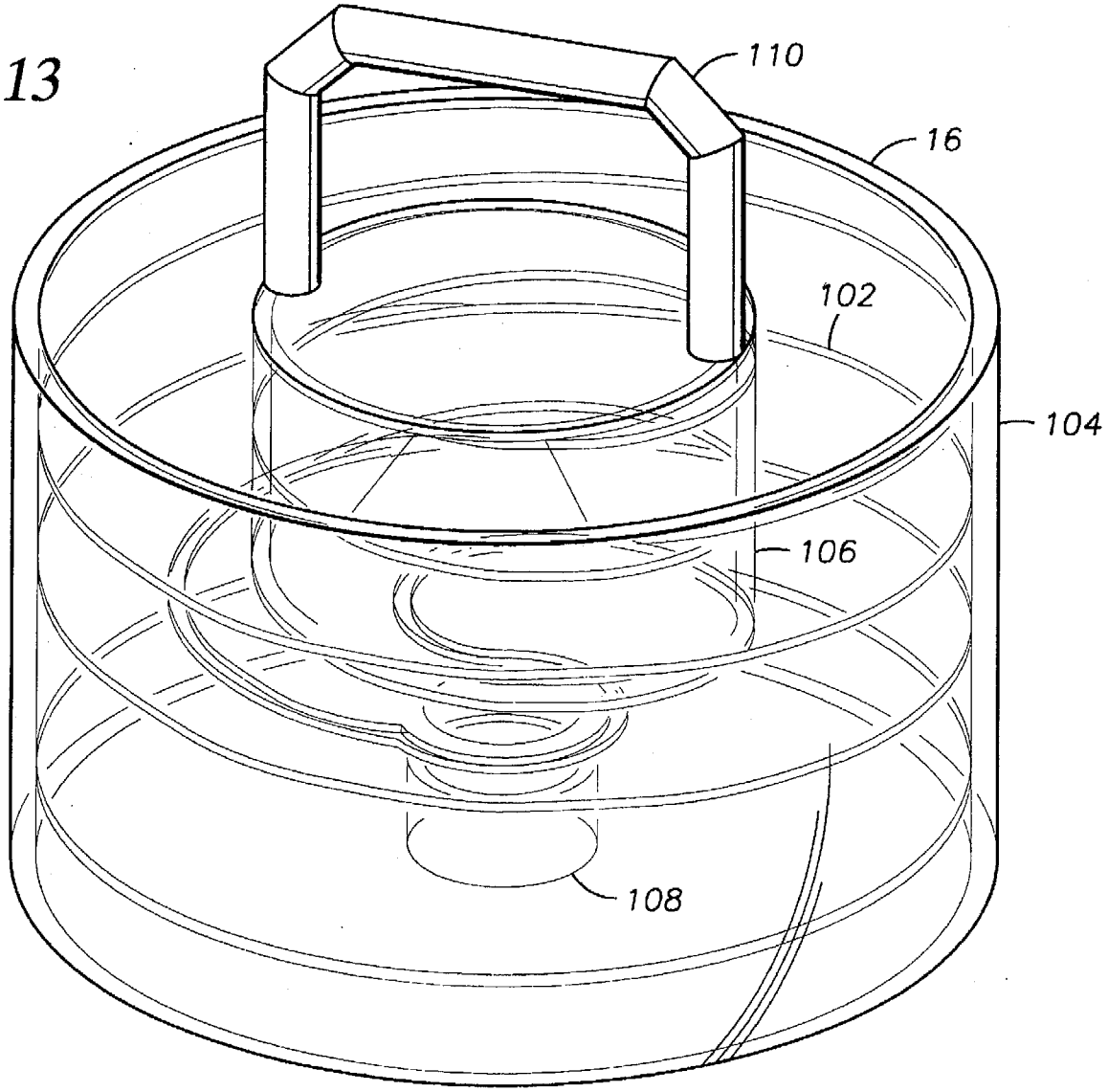
FIG. 13 is a schematic view of a golf ball magazine of the present invention.
Figure 14:
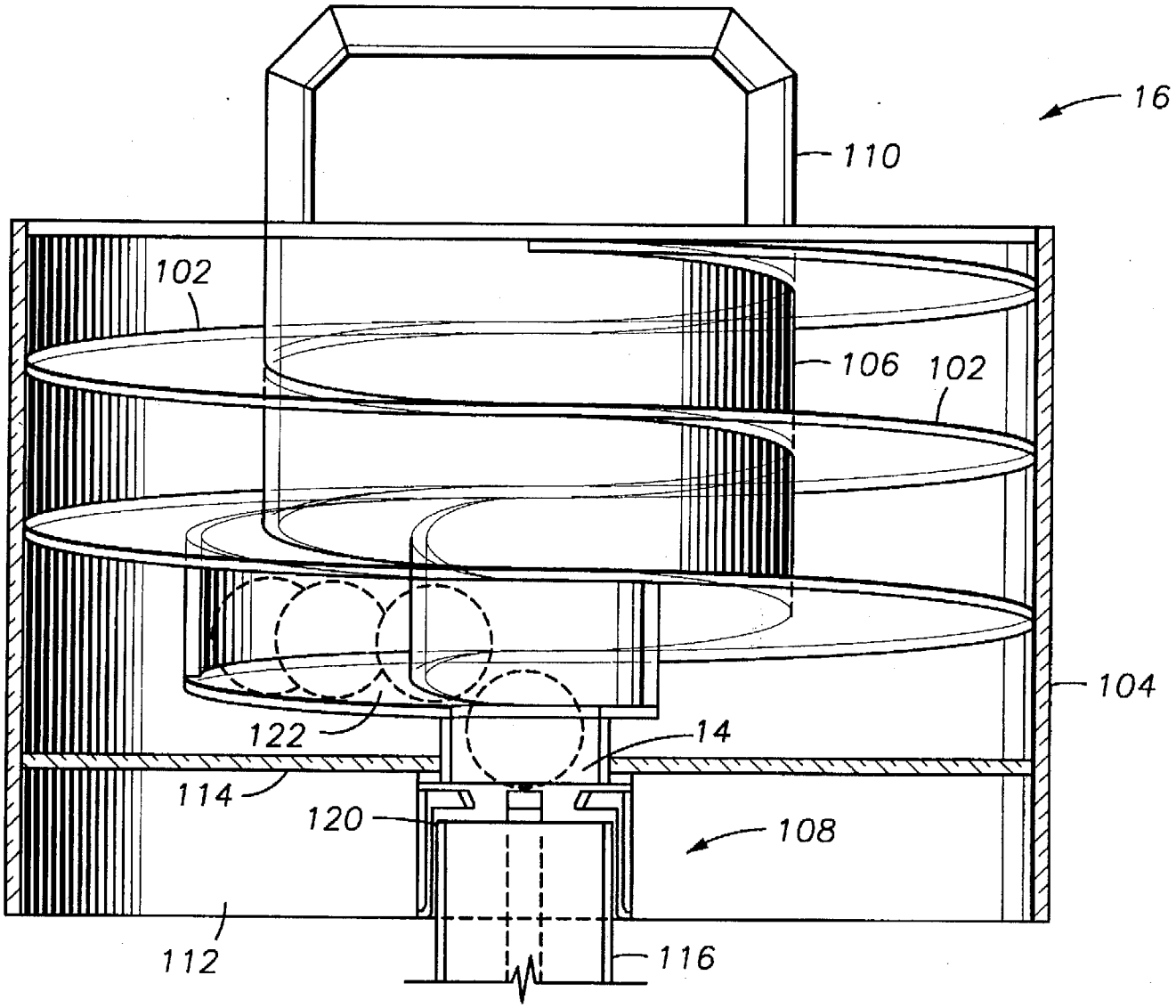
FIG. 14 is a side view of the golf ball magazine of the present invention.
Figure 15:
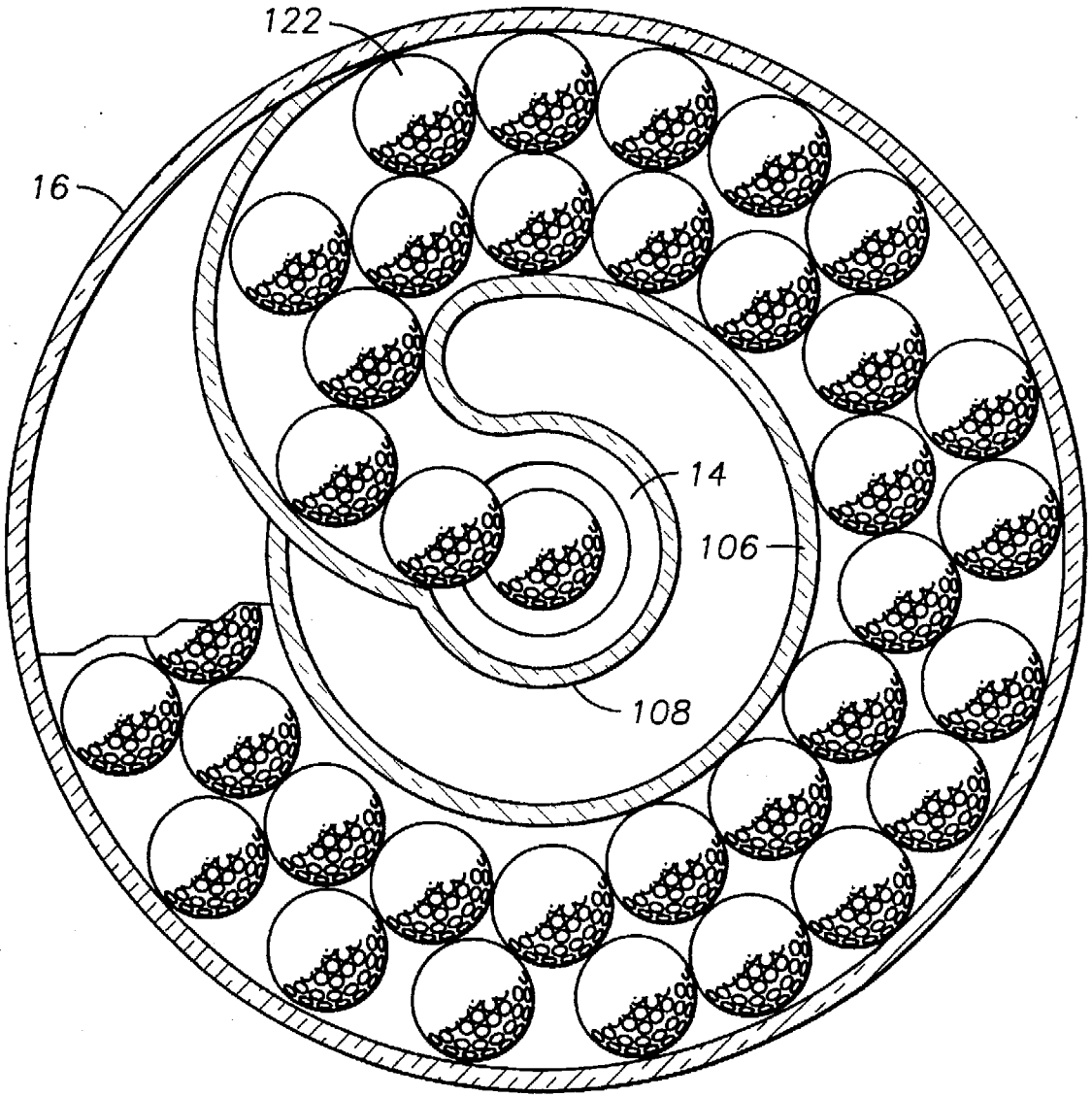
FIG. 15 is a top view of the golf ball magazine of the present invention.

FIGS. 13, 14 and 15 detail golf ball magazine 16. Golf ball magazine 16 dispenses golf balls to teeing apparatus 30. Golf ball magazine 16 is adapted to attach to the top portion of delivery chute 14.

FIG. 13 is a schematic view of golf ball magazine 16. A cylindrical magazine is shown having spiral flights 102. Cylindrical casing 104 forms the outer walls of golf ball magazine 16. Cylindrical core 106 forms the inner walls of golf ball magazine 16. Spiral flights 102 are disposed between cylindrical casing 104 and cylindrical core 106 of golf ball magazine 16. Receiving nozzle 108 is positioned on the bottom portion of golf ball magazine 16 adapted to connect to delivery chute 14 of golf station 2. Handle 110 is positioned on the top portion of golf ball magazine 16 to facilitate transport of golf ball magazine 16 from place of purchase to the golf station 2.

Golf balls are housed within golf ball magazine 16 to be dispensed upon use at golf station 2. Golf balls wind their way around spiral flights 102 to enter delivery chute 14. As the balls approach receiving nozzle 108, the balls merge for entry into delivery chute 14.

FIG. 14 shows a side view of golf ball magazine 16 which details spiral flights 102 and receiving nozzle 108 connecting delivery chute 14. Cylinder casing 104 and cylindrical core 106 support spiral flights 102 for ball delivery to delivery chute 14. The lower portion of cylindrical casing 104 terminates in skirt 112 which extends below the lower portion of bottom plate 114. Handle 110 is disposed on the top portion of golf ball magazine 16.

Receiving nozzle 108 delivers golf balls to the top portion of delivery chute 14. A spring loaded gate trap 116 prevents golf balls from exiting golf ball magazine 16 when not connected to delivery chute 14. On placement of golf ball magazine 16 over delivery chute 19, gate trap 116 retracts and aperture 118 widens to allow golf balls to pass therethrough and into delivery chute 14.

Gate trap 116 is disposed within receiving nozzle 108. Stop line 120 is positioned in receiving nozzle 108 to control depth of insertion by delivery chute 14. Gate trap 116 is made of four identical members disposed within receiving nozzle 108. Each piece is an elongate, substantially rectangular member attached to receiving nozzle 108 at the lower most portion of receiving nozzle 108. The attached, lower portion of the gate trap member is angled to allow delivery chute 1.4 to pass into receiving nozzle 108 and force the upper portion of the gate trap 108 members into a retracted position allowing golf ball passage into delivery chute 14.

FIG. 15 details ball movement through golf ball magazine 16. Cylindrical casing 104 and cylindrical core 106 define a passage through which golf balls pass toward delivery chute 14. Golf bails merge at point 122 just before entry into delivery chute 14. Delivery chute 14 is centered in golf ball magazine 16. Gravity feeds golf balls toward the center of the lower portion of the golf ball magazine 16.

Golf ball magazine 16 is preferably made of clear resin so as to provide a view of the balls left in the magazine.

It will be understood that certain combinations and subcombinations of the invention are of utility and may be employed without reference to other features in subcombination(s). This is contemplated by and is within the scope of the present invention. As many possible embodiments may be made of this invention without departing from the spirit and scope thereof, it is to be understood that all matters hereinabove set forth and shown in the accompanying drawing are to be interpreted as illustrative and not as limitations.

While the foregoing is directed to the preferred embodiments, the scope thereof is determined by the claims which follow:

What is claimed is:

1. A golf station, comprising:

(a) a circular frame member;

(b) a generally horizontal platform rotatably recessed within the frame member, the platform defining a golf ball passage;

(c) a ball elevating apparatus housed below the platform; and (d) a delivery chute fixedly attached to the platform to rotate in concert with the platform, the delivery chute having a top portion adapted for mounting a detachable golf ball magazine.

2. The golf station of claim 3 wherein the teeing apparatus further comprises an actuator, a first lever, a second lever, a loading lever, a pin lever, a piston, and a loading chamber wherein the actuator on depression contacts the first lever, the first lever contacts the second lever, the second lever contacts the piston which is partially disposed within the loading chamber, the piston contacts the loading lever, the loading lever contacts the pin lever, and the pin lever elevates a golf ball into the loading chamber and onto the piston.

3. The golf station of claim 2 wherein the detachable golf ball magazine comprises:

(a) a substantially cylindrical ball receptacle having an outer casing and an inner cylinder core;

(b) spiral flights disposed between the outer casing and the inner cylinder core;

(c) a receiving nozzle attached to the beginning of the spiral flights; and (d) a gate trap disposed within the receiving nozzle.

4. The golf station of claim 1 further comprising a detachable golf ball magazine adapted to connect to an upper portion of a delivery chute wherein the delivery chute is connected to the ball elevating apparatus and wherein the delivery chute is adapted to receive a plurality of golf balls.

5. The golf station of claim 4 wherein the ball elevating apparatus further comprises an actuator, a first lever, a second lever, a loading lever, a pin lever, a piston, and a loading chamber wherein the actuator on depression contacts the first lever, the first lever contacts the second lever, the second lever contacts the piston which is partially disposed within the loading chamber, the piston contacts the loading lever, the loading lever contacts the pin lever, and the pin lever elevates a golf ball into the loading chamber and onto the piston.

6. The golf station of claim 1 wherein the teeing apparatus is height adjustable by a cam.

7. The golf station of claim 1 further comprising a braking system for inhibiting the rotation of the platform.

8. A golf ball magazine for storing and delivering golf balls, comprising:

(a) a substantially cylindrical ball receptacle having an outer casing and an inner cylinder core;

(b) spiral flights disposed between the outer casing and the inner cylinder core;

(c) a receiving nozzle attached to the beginning of the spiral flights; and (d) a gate trap disposed within the receiving nozzle.

9. A golf ball teeing apparatus, comprising:

(a) an actuator mounted to a platform;

(b) a first lever pivotally mounted having first and second ends, wherein the first end contacts the actuator;

(c) a second lever pivotally mounted having first and second ends, wherein the second end of the first lever contacts the first end of the second lever and wherein the first end of the second lever is counterweighted so as to be normally displaced downward;

(d) a piston slidably mounted in a loading chamber wherein the second end of the second lever pivotally contacts the piston;

(e) a loading lever pivotally mounted having first and second ends, wherein the piston upon vertical movement contacts the first end of the loading lever;

(f) a pin lever having first and second ends, wherein the second end of the loading lever contacts the first end of the pin lever and wherein the second end of the pin lever pushes a golf ball into the loading chamber; and (g) a delivery chute for golf balls is attached to the loading chamber and contacts the pin lever.

10. The golf station of claim 9 further comprising a detachable golf ball magazine.

11. The golf station of claim 9 wherein the detachable golf ball magazine comprises:

(a) a substantially cylindrical ball receptacle having an outer casing and an inner cylinder core;

(b) spiral flights disposed between the outer casing and the inner cylinder core;

(c) a receiving nozzle attached to the beginning of the spiral flights; and (d) a gate trap disposed within the receiving nozzle.

12. A method of setting a golf ball in a practice teeing position comprising the steps of:

(a) pressing on an actuator mounted in a platform;

(b) the actuator lowering a first end of a first lever pivotally mounted, raising a second end of the first lever;

(c) the second end of the first lever raising a first end of a second lever pivotally mounted, wherein the second lever is counterweighted on the first end, further wherein a second end of the second lever is lowered correspondingly;

(d) the second end of the second lever lowering a piston slidably housed in a loading chamber, wherein the piston slides vertically in conjunction with the vertical movement of the second end of the second lever and wherein the piston lowers a first end of a loading lever, pivotally mounted, raising a second end of the loading lever;

(e) the loading lever contacting a pin lever pivotally mounted, wherein the pin ever positively pushes a golf ball over a lip and into the loading chamber; and (f) releasing the actuator which reverses the direction of movement of the first lever, the second lever, the piston, the loading lever, and pin lever, elevating the golf ball to a position above the platform.

* * * * *